United States Patent [19]

Whiting

[11] Patent Number: 4,616,127

[45] Date of Patent: Oct. 7, 1986

[54] FIRE CONTROL SYSTEM FOR A VEHICLE OR VESSEL

[75] Inventor: Ian G. Whiting, Borne, Netherlands

[73] Assignee: Hollandse Signaalapparaten B.V., Hengelo, Netherlands

[21] Appl. No.: 525,192

[22] Filed: Aug. 22, 1983

[30] Foreign Application Priority Data

Sep. 3, 1982 [NL] Netherlands ..... 8203445

[51] Int. Cl.[4] ..... G05D 3/00; G06F 15/58; F41G 3/22

[52] U.S. Cl. ..... 235/412; 235/411; 364/423

[58] Field of Search ..... 364/423; 235/404, 410, 235/411, 412

[56] References Cited

U.S. PATENT DOCUMENTS

| | | | |
|---|---|---|---|
| 3,575,085 | 4/1971 | McAdam | 235/404 |
| 3,743,818 | 7/1973 | Marasco et al. | 235/404 |
| 3,798,420 | 3/1974 | Kaaz | 235/404 |
| 4,128,837 | 12/1978 | Page | 235/412 X |
| 4,179,696 | 12/1979 | Quesinberry et al. | 235/412 X |
| 4,224,507 | 9/1980 | Gendreu | 235/412 |
| 4,320,287 | 3/1982 | Rawicz | 235/412 |

OTHER PUBLICATIONS

Neumann: Leopard 2 Fire Control System Soldat und Technik, Oct. 1980, pp. 554–557, Published Frankfurt am Main, German Fed. Republic copy in 235–412.

*Primary Examiner*—Felix D. Gruber

*Attorney, Agent, or Firm*—Thomas A. Briody; William J. Streeter; Leroy Eason

[57] ABSTRACT

In a fire control system for a vehicle or vessel a data processor (21) connected to the target tracking unit (7) determines, in a first coordinate system coupled to said unit (7), angular error data about a target position for aligning the tracking unit (7) with the target position.

A fire control computer (22) is incorporated for:

a. determining matrix (H) elements concerning the transformation from the first coordinate system to a second fixed horizontal coordinate system, using data about relative angular positions between the tracking unit (7), the vehicle or vessel and a turret mounted thereon, and using data from reference orientation means (18, 19, 20) about the angular positions in said second coordinate system;

b. converting the angular error data into target positions in said second coordinate system;

c. changing said target positions to gun aiming data; and d. transforming the latter data to a third coordinate system coupled to the vehicle or vessel.

4 Claims, 4 Drawing Figures

FIRE CONTROL SYSTEM FOR A VEHICLE OR VESSEL

BACKGROUND OF THE INVENTION

The invention relates to a fire control system for a vehicle or vessel, which fire control system is provided with:

a turret and gun;

a target tracking unit;

a data processor connected to the target tracking unit for determining, in a first coordinate system coupled to the target tracking unit, angular (error) data about the position of the target being tracked;

a servo control unit connected to the data processor for aligning the target tracking unit with the target position by means of the angular error data supplied; and a fire control computer for determining, from a series of successive positions of the target tracking unit and target range values, associated target positions in a second, fixed horizontal coordinate system, and for generating, from said target positions, gun aiming data for transmission to the turret and gun.

Such a fire control system for a vehicle or vessel is widely known.

With a combat vehicle fitted with a spring-suspended chassis on pneumatic tires and with the abovementioned fire control system, it is customary to stop the vehicle when entering the aiming phase of the gun and to give the vehicle a stable position by means of collapsible levelling jacks. This ensures that with a burst of fire the position of the combat vehicle will not be subject to change through the gun recoil. The use of these levelling jacks for such a vehicle could of course be dispensed with if only one single round need be fired. Furthermore, a heavy combat vehicle, such as a tank, need not be fitted with levelling jacks since, due to the large mass of the vehicle, the recoil of the gun when fired has no appreciable effect on the position of this vehicle. The adjustment of levelling jacks for a combat vehicle fitted with a spring-suspended chassis on pneumatic tires and with the above-mentioned fire control system is however time-consuming, and hence a disadvantage of such a combat vehicle.

SUMMARY OF THE INVENTION

The present invention has for its object to obviate the disadvantage with the use of the above fire control system for a vehicle fitted with a spring-suspended chassis on pneumatic tires or for a rolling vessel.

According to the invention, in a fire control system of the type set forth in the opening paragraph the fire control computer comprises a (first) coordinate conversion unit for determining the elements of the transformation matrix (H) associated with the transformation from the first coordinate system to the second coordinate system, using supplied data concerning the relative angular positions measured at the axes of rotation between the target tracking unit, the turret, and the vehicle or vessel, and using data supplied by reference orientation means and concerning the angular positions with respect to the tilt of the vehicle or vessel in the second coordinate system, and for converting the angular error data obtained from the data processor in the first coordinate system into target positions in the second coordinate system, using the elements of said transformation matrix. The fire control computer further comprises a (second) coordinate conversion unit for transforming, on the basis of the data supplied by said reference orientation means, the gun aiming data determined in the second coordinate system to a third coordinate system coupled to the vehicle or vessel.

A preferred embodiment of a fire control system, according to the invention, for a vehicle fitted with a spring-suspended chassis or a vessel subject to roll, pitch and yaw motions is obtained by transforming the gun aiming data determined in the second coordinate system first to the first coordinate system, using matrix $H^*$, where $H^* = H^{-1}$, being the inverse of matrix H, and by transforming the gun aiming data determined in the first coordinate system to the third coordinate system on the basis of the data concerning the angular positions at the axes of rotation between the target tracking unit, the turret, and the vehicle or vessel.

BRIEF DESCRIPTION OF THE DRAWING

The invention will now be described with reference to the accompanying figures, of which.

DESCRIPTION OF THE PREFERRED EMBODIMENT

Figure 1:
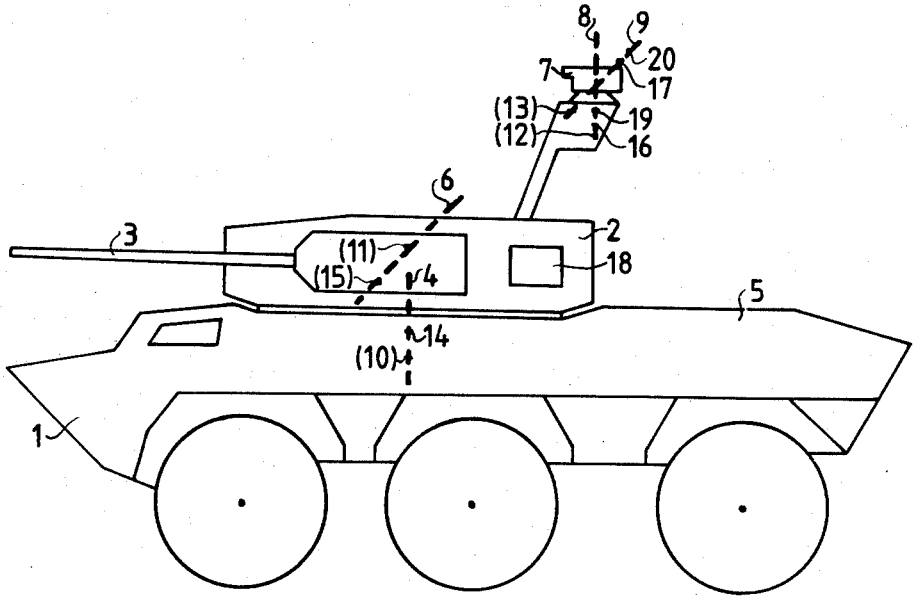
FIG. 1 is a schematic representation of a vehicle fitted with a fire control system.

FIG. 1 shows a three-axle combat vehicle 1, provided with a turret 2 and gun 3. Vehicle 1 is fitted with a spring-suspended chassis on pneumatic tires. The turret 2 is rotatable about an axis 4, which is perpendicular to the roof 5 of vehicle 1. The gun 3 is movable in elevation about an axis 6 in the turret 2; axis 6 is oriented parallel to the roof 5. Mounted on the turret 2 is a target tracking unit 7 for tracking a target in range and in angles. The target tracking unit 7 may consist of a radar tracking apparatus, a laser range detector, an infrared tracking unit, a TV tracking unit or optical detection means (periscope, binocular), as well as combinations thereof. The target tracking unit 7 is biaxially connected with the turret 2, one axis 8 being oriented parallel to or coaxially with axis 4 on the turret 2 and the other axis 9 parallel to the roof 5. The relative motion of the turret 2 with respect to the vehicle 1 (about axis 4), the gun 3 with respect to the turret 2 (about axis 6), and the target tracking unit 7 with respect to the turret 2 (about axes 8 and 9), is achieved by servo control units 10, 11, 12 and 13, respectively, shown schematically in FIG. 1. The angular rotations of the turret 2 with respect to the vehicle 1 (about axis 4), the gun 3 with respect to the turret 2 (about axis 6), and the target tracking unit 7 with respect to the turret 2 (about axes 8 and 9) are measured by angle data transmitters 14, 15, 16 and 17, respectively, shown schematically in FIG. 1, which transmitters may be synchros, digital angle data transmitters, etc.

The vehicle 1 is further provided with reference orientation means for obtaining time-reliable data about the orientation of the vehicle with respect to a fixed horizontal (second) coordinate system; the reference orientation means may consist of a three-axis, vertical gyroscope 18 and/or rate gyroscopes 19 and 20, shown schematically. The rate gyroscopes 19 and 20 are mounted on the axes 8 and 9 and furnish data about the angular velocities of the rate gyroscopes relative to the fixed horizontal plane. After fractional integration and after correction for the initial values of the tilt of target tracking unit 7, as determined by gyroscope 18, the results obtained from the measurements of these angular velocities yield the instantaneous tilt angles of a plane defined by axis 9 and the line of sight of the target tracking unit 7, which tilt angles are relative to the fixed horizontal plane. It should be noted that axis 9 may be tilted at an angle to the base plane of the second coordinate system through the combat vehicle being located on hilly ground and/or through the recoil of the gun 3. The required initial values of the tilt may be furnished separately, for instance, by gyroscope 18. With such a (joint) operation of gyroscope 18 and rate gyroscopes 19 and 20 it suffices to use a coarse, single-axis gyroscope 18 and accurate rate gyroscopes 19 and 20. In the absence of rate gyroscopes 19 and 20, the gyroscope 18 should be multi-axial and should provide accurate measuring results.

Figure 2:
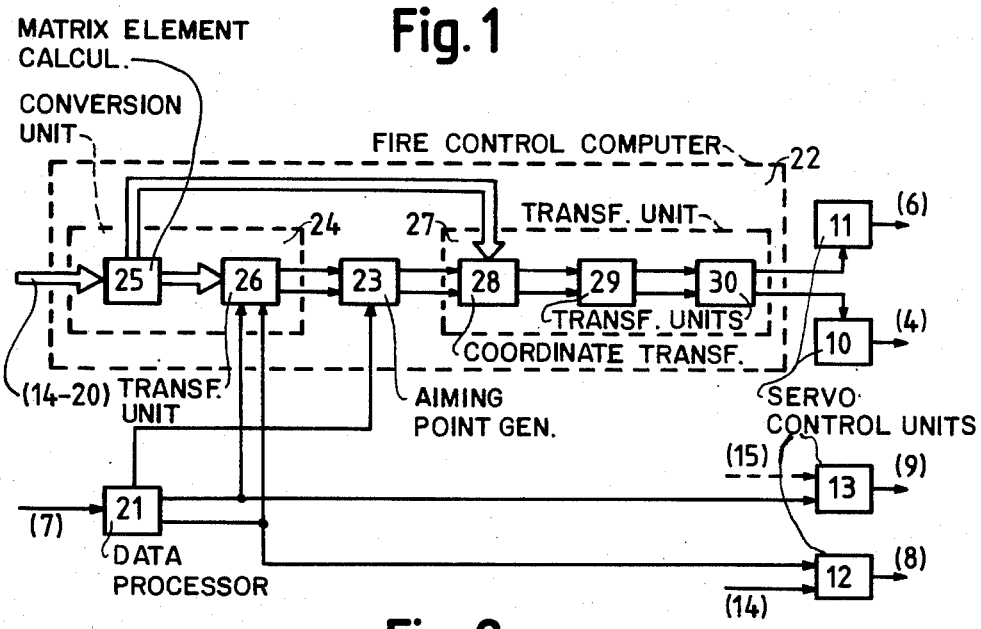
FIG. 2 is a block diagram of a fire control system, according to the invention, for a vehicle or vessel.

FIG. 2 is a block diagram of a fire control system for the combat vehicle 1 of FIG. 1. The fire control system contains a data processor 21, which is fed with angle and range data from the target tracking unit 7. During target tracking the data processor 21 furnishes data about the angular deviation between the line of sight of the target tracking unit 7 and the target line of sight, and hence target positional values in a first coordinate system coupled to the target tracking unit 7 and oriented perpendicularly to the line of sight of this unit. In a fire control computer 22 the target positional values are converted to a second, fixed horizontal coordinate system to generate the target track by means of an aiming-point generator 23 and, hence, to calculate aiming values for the gun 3. The fire control computer 22 comprises a first coordinate conversion unit 24, containing means 25 for establishing the elements of the matrix (H) associated with the transformation of the first coordinate system coupled to the target tracking unit 7 to the second coordinate system. Means 25 is supplied with the data from the angle data transmitters 14–17 and the reference orientation means 18, 19 and 20. For the transformation (H) of a target position $(\vec{z})$ from the target tracking unit 7 to the second horizontal coordinate system the first coordinate conversion unit 24 further contains another transformation unit 26 to provide $H(\vec{z})$ as the target position in the second coordinate system. On the basis of a series of target positions thus obtained (in the second coordinate system) and an associated series of target range values obtained from data processor 21, the aiming-point generator 23 is capable of generating the target track and calculating aiming values with the aid of additionally supplied data about ballistic corrections to be made and the data from rate gyroscope 18 about the gravitational direction.

Since the gun 3 is always aimed relative to the vehicle 1, the aiming data must be transformed from the second coordinate system to a third coordinate system coupled to the vehicle 1. To carry out such a transformation V, the fire control computer 22 comprises a transformation unit 27, using a matrix whose elements are calculable with the aid of the data supplied by the reference orientation means 18, 19 and 20. A preferred embodiment of such a transformation unit 27 comprises: a unit 28 for transforming the aiming values from the second coordinate system to the first coordinate system coupled to the target tracking unit 7; a unit 29 for transforming the aiming values obtained from unit 28 in the first coordinate system to a coordinate system coupled to the turret 2; and a unit 30 for transforming the aiming values obtained from unit 29 to the third coordinate system coupled to the vehicle 1. The transformation in unit 28 is realised by elements of a matrix $H^*$, where $H^* = H^{-1}$, being the inverse of matrix H, while the transformation in units 29 and 30 consists of correcting the supplied aiming values obtained from the angular values of the angle data transmitters. The aiming values thus obtained are supplied to servo control units 10 and 11.

Servo control unit 13 coupled to axis 9 is controlled with the angular error data of data processor 21 measured along the coordinate axis of the first coordinate system which is perpendicular to axis 9. Rotation of turret 2 about axis 4 also changes the position of the spatial aiming point of target tracking unit 7; to obtain a true tracking motion of tracking unit 7, any interferences in the tracking motion of target tracking unit 7, due to rotation of turret 2, must be compensated. To this effect the servo control unit 12 acting about axis 8 receives the angular data from angle data transmitter 14, in addition to the angular error data supplied by data processor 21 and measured along the coordinate axis of the first coordinate system which is parallel to axis 9. If target tracking unit 7 were rotatably mounted on the gun 3, the servo control unit 13 would have to be supplied with the angular data from angle data transmitter 15, as well as with the angular error data from data processor 21.

The above-described fire control system is also applicable to rolling vessels, where the transformation of the target coordinates to the second coordinate system according to matrix H compensates for the roll, pitch and yaw motions of the vessel.

If the target tracking unit 7 is directly and rotatably mounted on the roof 5 of the vehicle, the units 29 and 30 are of a combined design.

Reaction forces exerted on the vehicle or vessel due to bursts of fire are measured in the target tracking unit 7 and in the reference orientation means 18 and/or 19, 20. Under these conditions, the angular data from data processor 21, as well as the elements of matrix H constituted by means 25, are subject to change, such that the result of transformation unit 26, i.e. $H(\vec{z})$, represents the true target motion, undisturbed by the gun recoil. Also the rocking motions of the combat vehicle driving on hilly ground or the rolling motions of a ship have no influence on the target position $H(\vec{z})$ produced. The target data transformation in the first coordinate system, coupled to target tracking unit 7, on the basis of the position of target tracking unit 7 in the fixed horizontal system, thus provides true target data in the horizontal coordinate system, which does not show any dependency on the target tracking unit 7 subjected to motion.

A condition for proper operation of the above fire control system is however that the processing of the target motion, varying as a consequence of the vehicle or vessel motions, as performed by the target tracking unit 7 and data processor 21, be in synchronism with the processing of the associated data from the reference orientation means (18 and/or 19, 20) and angle data transmitters 14–17, as performed by means 25. This processing rate should be sufficiently large to permit any corrections to be made to the measured target positions during a burst of fire on account of the gun recoil, in order to position the gun 3 in accordance with the aiming values (still subject to variations at that time) during this burst.

Figure 3:
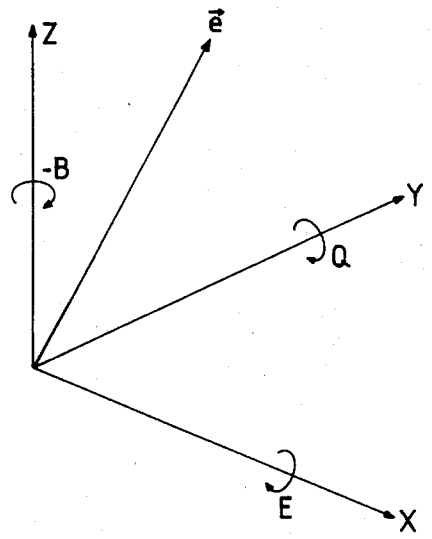
FIGS. 3 and 4 are orthogonal coordinate systems containing transformations to be effected.
Figure 4:
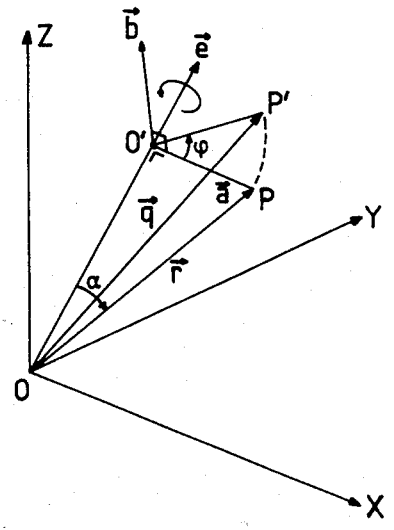

The form of matrix H may be obtained as follows: FIG. 3 shows the orthogonal first coordinate system coupled to the target tracking unit 7, to be rotated through an angle $\phi$ about an axis $\vec{e}$ to obtain the fixed, horizontal, second coordinate system. In the X, Y and Z directions the reference orientation means measure the results E, Q and B, where the rotation vector $\vec{e}^T$ is defined. The direction cosines of rotation vector $\vec{e}^T$ are:

$$l = \frac{E}{\phi},\ m = \frac{Q}{\phi} \text{ and } n = \frac{-B}{\phi},\ \text{where } \phi = \sqrt{E^2 + Q^2 + B^2}.$$

Instead of rotating the coordinate axes X, Y and Z, it is possible to rotate a random vector $\vec{r}$ through an angle $\phi$ about the axis $\vec{e}$. To this effect, allow a plane to cut vector $\vec{r}$ at point P and to pass axis $\vec{e}$ at right angles. In this plane two mutually perpendicular unit vectors $\vec{a}$ and $\vec{b}$ are chosen, vector $\vec{a}$ lying along the line 0'P, where 0' is the point of intersection of this plane with vector $\vec{e}$. The two unit vectors $\vec{a}$ and $\vec{b}$ may be expressed by:

$$\vec{a} = \vec{r} - (\vec{e}, \vec{r})\vec{e}$$

and $$\vec{b} = [\vec{e} \times \vec{r}].$$

The vector $\vec{q}$ obtained after rotation through angle $\phi$ is given by:

$$\begin{aligned}\vec{q} = H(\vec{r}) &= (\vec{e}, \vec{r})\vec{e} + (\cos\phi \cdot \vec{a} + \sin\phi \cdot \vec{b}) \\ &= (\vec{e}, \vec{r})\vec{r} + \cos\phi \cdot (\vec{r} - (\vec{e}, \vec{r})\vec{e}) + \sin\phi \cdot [\vec{e} \times \vec{r}] \\ &= \cos\phi \cdot \vec{r} + (1 - \cos\phi) \cdot (\vec{e}, \vec{r})\vec{e} + \sin\phi \cdot \vec{b} \\ &= \cos\phi \cdot I(\vec{r}) + (1 - \cos\phi) \cdot A(\vec{r}) + \sin\phi \cdot G(\vec{r})\end{aligned}$$

where:

$$A = \begin{pmatrix} l^2 & lm & ln \\ lm & m^2 & nm \\ ln & mn & n^2 \end{pmatrix} \quad A^T = A$$

$$G = \begin{pmatrix} 0 & -n & m \\ n & 0 & -l \\ -m & l & 0 \end{pmatrix} \quad G^T = -G$$

$$I = \begin{pmatrix} 1 & 0 & 0 \\ 0 & 1 & 0 \\ 0 & 0 & 1 \end{pmatrix}$$

The matrix H to transform $\vec{r}$ to $\vec{q}$ will be:

$$H = \begin{pmatrix} l^2(1 - \cos\phi) + \cos\phi & ml(1 - \cos\phi) - n \cdot \sin\phi & nl(1 - \cos\phi) + m \cdot \sin\phi \\ ml(1 - \cos\phi) + n \cdot \sin\phi & m^2(1 - \cos\phi) + \cos\phi & mn(1 - \cos\phi) - l \cdot \sin\phi \\ nl(1 - \cos\phi) - m \cdot \sin\phi & mn(1 - \cos\phi) + l \cdot \sin\phi & n^2(1 - \cos\phi) + \cos\phi \end{pmatrix}$$

Since the rotation angle $\phi$ may usually be considered small, $\cos\phi$ and $\sin\phi$ may be approximated by $1\text{-}\phi^2$ and $\phi$, respectively. After substitution of l, m and n for their equivalent expressions, the matrix H obtained is:

$$H = \begin{pmatrix} 1 - \frac{1}{2}B^2 - \frac{1}{2}Q^2 & \frac{1}{2}EQ + B & -\frac{1}{2}EB + Q \\ \frac{1}{2}EQ - B & 1 - \frac{1}{2}B^2 - \frac{1}{2}E^2 & -\frac{1}{2}BQ - E \\ -\frac{1}{2}EB - Q & -\frac{1}{2}BQ + E & 1 - \frac{1}{2}E^2 - \frac{1}{2}Q^2 \end{pmatrix}$$

I claim:

1. A fire control system for a vehicle/vessel-mounted weapon, said system comprising:

a. a turret-mounted gun;

b. a target tracking unit rotatable about orthogonal axes defining a coordinate system for tracking a target;

c. a target position data processor electrically connected to the target tracking unit for determining in the target tracking coordinate system annular error data instantaneously establishing the position of a target being tracked;

d. a servo control unit electrically connected to the target position data processor for aiming the target tracking unit at the target in response to the angular error data determined by the data processor;

e. reference orientation means for defining a geographically fixed reference coordinate system and for determining the instantaneous orientation relative thereto of a coordinate system defined by the vehicle/vessel;

f. a fire control computer including:

1. a first coordinate conversion unit electrically connected to the target tracking unit, to the reference orientation means and to the target position data processor for producing from the data provided thereby the elements of a transformation matrix H for transforming successive target position data in the target position coordinate system into successive target position data in the reference coordinate system;

2. an aiming point generator electrically connected to the first coordinate conversion unit for producing from the successive target position data in the reference coordinate system gun aiming data in such reference coordinate system;

3. a second coordinate conversion unit electrically connected to the aiming point generator and to the reference orientation means and comprising means for transforming the gun aiming data from the reference coordinate system to the target position coordinate system and further means for transforming the gun aiming data from the target position coordinate system to the vehicle/vessel coordinate system; and g. means electrically connected to the second coordinate conversion unit for controlling the aiming of the gun in the vehicle/vessel coordinate system in response to the gun aiming data produced in that coordinate system by the second coordinate conversion unit.

2. A fire control system for a vehicle or vessel as claimed in claim 1, characterised in that the transformation matrix H is based on the matrix applicable to a coordinate transformation of an orthogonal coordinate system (X, Y, Z) rotated through an angle:

$$H = \begin{pmatrix} l^2(1 - \cos\phi) + \cos\phi & ml(1 - \cos\phi) - n \cdot \sin\phi & nl(1 - \cos\phi) + m \cdot \sin\phi \\ ml(1 - \cos\phi) + n \cdot \sin\phi & m^2(1 - \cos\phi) + \cos\phi & mn(1 - \cos\phi) - l \cdot \sin\phi \\ nl(1 - \cos\phi) - m \cdot \sin\phi & mn(1 - \cos\phi) + l \cdot \sin\phi & n^2(1 - \cos\phi) + \cos\phi \end{pmatrix}$$

where $l = \frac{E}{\phi}$ ; $m = \frac{Q}{\phi}$ and $n = \frac{-B}{\phi}$ ; and $\phi = \sqrt{E^2 + Q^2 + B^2}$ , while E, Q and B represent the measured rotation values on the X, Y and Z axes, respectively.

3. A fire control system for a vehicle or vessel as claimed in claim 1, characterised in that the matrix H is of the form:

$$H = \begin{pmatrix} 1 - \frac{1}{2}B^2 - \frac{1}{2}Q^2 & \frac{1}{2}EQ + B & -\frac{1}{2}EB + Q \\ \frac{1}{2}EQ - B & 1 - \frac{1}{2}B^2 - \frac{1}{2}E^2 & -\frac{1}{2}BQ - E \\ -\frac{1}{2}EB - Q & -\frac{1}{2}BQ + E & 1 - \frac{1}{2}E^2 - \frac{1}{2}Q^2 \end{pmatrix}$$

4. A fire control system for a vehicle or vessel as claimed in claim 1, characterised in that the means comprised in the second coordinate conversion unit for transforming the supplied gun aiming data from the reference coordinate system to the target tracking coordinate system uses a matrix H*, where H* is the inverse of matrix H.

* * * * *